US008794045B2

(12) United States Patent
Norikura et al.

(10) Patent No.: US 8,794,045 B2
(45) Date of Patent: Aug. 5, 2014

(54) CLUSTER-TYPE MULTISTAGE ROLLING MILL

(75) Inventors: Takashi Norikura, Tokyo (JP); Michimasa Takagi, Hiroshima (JP); Shin Ozeni, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 466 days.

(21) Appl. No.: 12/939,220

(22) Filed: Nov. 4, 2010

(65) Prior Publication Data

US 2011/0113847 A1 May 19, 2011

(30) Foreign Application Priority Data

Nov. 5, 2009 (JP) ..... 2009-253685

(51) Int. Cl.
*B21B 31/00* (2006.01)
*B21B 29/00* (2006.01)

(52) U.S. Cl.
USPC ..... 72/242.4; 72/237

(58) Field of Classification Search
USPC ..... 72/237, 245, 242.2, 242.4, 241.4, 72/243.2, 243.4, 241.2, 238, 248
See application file for complete search history.

(56) References Cited

U.S. PATENT DOCUMENTS

| | | | | |
|---|---|---|---|---|
| 3,815,401 | A * | 6/1974 | Sendzimir et al. | 72/242.4 |
| 3,858,424 | A * | 1/1975 | Kajiwara et al. | 72/242.4 |
| 4,107,971 | A * | 8/1978 | Hunke | 72/237 |
| 5,142,896 | A * | 9/1992 | Berger et al. | 72/242.4 |
| 5,596,899 | A * | 1/1997 | Sendzimir et al. | 72/242.4 |
| 6,116,073 | A * | 9/2000 | Kajiwara et al. | 72/242.4 |
| 6,260,397 | B1 * | 7/2001 | Zheng et al. | 72/237 |
| 6,725,701 | B2 * | 4/2004 | Nakayama et al. | 72/237 |
| 7,765,844 | B2 * | 8/2010 | Guo | 72/242.4 |
| 2002/0152787 | A1 | 10/2002 | Nakayama et al. | |

FOREIGN PATENT DOCUMENTS

| | | | |
|---|---|---|---|
| CN | 1371769 | A | 10/2002 |
| JP | 2002-239608 | A | 8/2002 |

* cited by examiner

*Primary Examiner* — Edward Tolan
*Assistant Examiner* — Mohammad I Yusuf
(74) *Attorney, Agent, or Firm* — Birch, Stewart, Kolasch & Birch, LLP

(57) ABSTRACT

A cluster-type multistage rolling mill includes: a top inner housing a top roll group; a bottom inner housing a bottom roll group; an entry-side outer housing provided at entry sides of the inner housings and having an opening portion which a strip is allowed to pass through; a delivery-side outer housing provided at delivery sides of the inner housings and having an opening portion which the strip is allowed to pass through; sets of pass line adjusters provided in upper portions of the opening portions, and pressing an entry-side pressing portion and a delivery-side pressing portion of the top inner housing, respectively; and sets of roll gap controlling cylinders provided in lower portions of the opening portions, and pressing an entry-side pressing portion and a delivery-side pressing portion of the bottom inner housing, respectively.

9 Claims, 11 Drawing Sheets

CLUSTER-TYPE MULTISTAGE ROLLING MILL

TECHNICAL FIELD

The present invention relates to a cluster-type multistage rolling mill using small-diameter work rolls which are effective in rolling a hard strip with a high strip thickness gauge accuracy.

BACKGROUND ART

Heretofore, it has been common practice to use small-diameter work rolls to roll hard materials, such as a magnetic steel strip, a stainless steel strip, and a high-tension steel strip, with a high strip thickness gauge accuracy. Rolling mills using such small-diameter work rolls are configured such that horizontally split housings, namely, a top inner housing and a bottom inner housing are used to respectively support a top roll group, which supports a top work roll and includes rolls arranged in a clustered form, and a bottom roll group, which supports a bottom work roll and includes rolls arranged in a clustered form. Further, a drive-side outer housing and a work-side outer housing are used to support the top inner housing and the bottom inner housing.

A cluster-type multistage rolling mill of such type is disclosed in Patent Literature 1, for example.

CITATION LIST

Patent Literature

{Patent Literature 1} Japanese Patent Application Publication No. 2002-239608

SUMMARY OF INVENTION

Technical Problem

Here, a conventional cluster-type multistage rolling mill as mentioned above will be described in detail by using FIGS. 9 to 11. Note that the paths through which rolling reaction force P is transmitted at the time of rolling (i.e., the proportions of rolling reaction force applied) are identical between a top roll group 21*a* and a bottom roll group 21*b*. Thus, in FIGS. 10 and 11, how deformation occurs is illustrated only for a top inner housing 122*a*.

First, FIG. 9 illustrates the proportions of rolling reaction force applied to four pairs of top and bottom backing bearings 34*a* and 34*b* at the time of rolling. Reference signs A to D in FIG. 9 indicate the positions of the shaft centers of the backing bearings 34*a* and 34*b*.

In the rolling using the conventional cluster-type multistage rolling mill, rolling reaction force P from a strip 1 acts on work rolls 31*a* and 31*b*. This rolling reaction force P is distributed to the backing bearings 34*a* and 34*b* through first intermediate rolls 32*a* and 32*b* and second intermediate rolls 33*a* and 33*b*. As a result, rolling reaction force of 0.66 P is applied to the backing bearings 34*a* and 34*b* at the positions A and D, and rolling reaction force of 0.36 P is applied to the backing bearings 34*a* and 34*b* at the positions B and C. In other words, the proportions of the rolling reaction force applied to the backing bearings 34*a* and 34*b* at the positions A and D are 66%, while the proportions of the rolling reaction force applied to the backing bearings 34*a* and 34*b* at the positions B and C are 36%.

In this event, as shown in FIG. 10, the rolling reaction force distributed to the backing bearings 34*a* at the positions A and D acts in nearly horizontal directions. This leads to the deformation of the top inner housing 122*a* in the horizontal directions. Such deformation of the top inner housing 122*a* caused by the application of large rolling reaction force to the backing bearings 34*a* at the positions A and D is what is called "bore opening." This bore opening occurs in the bottom inner housing as well. When the bore opening occurs in the top inner housing 122*a* as described above, the work roll 31*a* is separated from the strip 1, which in turn lowers the vertical rigidity. This may possibly result in the lowering of the strip thickness gauge accuracy of the strip 1.

Thus, the conventional cluster-type multistage rolling mill is configured as below to improve its vertical rigidity so that the occurrence of bore opening can be suppressed. Specifically, the top inner housing 122*a* is supported at its drive side and work side by a drive-side outer housing and a work-side outer housing each at two points in a front side and a back side with respect to the transport direction of a strip 1.

According to this conventional configuration, however, the distance between the centers of the two supporting positions in the strip transport direction (corresponding to distances Kit and Kib to be described later) is short, and also these supporting positions are set at the highest locations in the top inner housing 122*a*. This may cause a problem that a sufficient vertical rigidity cannot be secured.

Moreover, according to the conventional configuration, the distance between the centers of the supporting positions in both the drive and work sides in the strip width direction (corresponding to distances Lit and Lib to be described later) is long. This may cause another problem that a sufficient horizontal rigidity cannot be secured. When a sufficient horizontal rigidity cannot be secured, the top inner housing 122*a* may deflect greatly in the strip width direction at the time of rolling. FIG. 11 shows how deformation occurs in the top inner housing 122*a* without a sufficient horizontal rigidity.

Now, in FIG. 11, see the distribution, in the strip width direction, of rolling reaction force acting direction displacements of the top inner housing 122*a* caused by the backing bearings 34*a* at the positions A and D. The distribution shows that the rolling reaction force acting direction displacement is significantly larger at a middle portion in the strip width direction than at two end portions in the strip width direction.

Then, the rolling reaction force acting direction displacements of the top inner housing 122*a* at the middle and two end portions in the strip width direction caused by the backing bearings 34*a* at the positions A and D are converted into rolling reaction force acting direction displacements of the work roll 31*a* at a middle and two end portions in the strip width direction caused by the backing bearings 34*a* at the positions A and D. For the work roll 31*a* too, the rolling reaction force acting direction displacement is larger at the middle portion in the strip width direction than at the two end portions in the strip width direction. Accordingly, a strip 1 is pressed deeper at its two end portions in the strip width direction than at its middle portion in the strip width direction, whereby the strip thickness of the strip 1 becomes greater at the middle portion in the strip width direction than at the two end portions in the strip width direction.

Thus, as mentioned above, the conventional configuration does not have sufficient vertical and horizontal rigidities and therefore the work roll 31*a* is likely to be separated from the strip 1. This as a result creates a large gap 6*o* as shown in FIG. 10 between the strip 1 and the work roll 31*a*, whereby the strip thickness gauge accuracy of the strip 1 may possibly be lowered.

Meanwhile, in the case of the conventional cluster-type multistage rolling mill, it may be conceivable to increase the sizes of the top inner housing and the bottom inner housing to improve the vertical and horizontal rigidities. However, employing such configuration increases not only the weights of the top inner housing and the bottom inner housing but also the sizes and hence the weights of the drive-side outer housing and the work-side outer housing supporting the inner housings in a surrounding manner.

So, the present invention has been made to solve the above problems and an object thereof is to provide a cluster-type multistage rolling mill whose size and weight can be reduced, and also whose rigidity can be improved so that a strip can be rolled with a high strip thickness gauge accuracy.

Solution to Problem

A cluster-type multistage rolling mill according to a first aspect of the present invention solving the above problems includes: a top inner housing located above a pass line of a strip and housing a top roll group including rolls arranged in a clustered form; a bottom inner housing located below the pass line of the strip and housing a bottom roll group including rolls arranged in a clustered form; an entry-side outer housing provided at entry sides of the top inner housing and the bottom inner housing and having an entry-side opening portion which the strip is allowed to pass through; a delivery-side outer housing provided at delivery sides of the top inner housing and the bottom inner housing and having a delivery-side opening portion which the strip is allowed to pass through; pass line adjusting means for adjusting a height of the pass line of the strip by pressing an entry side and a delivery side of the top inner housing from above, the pass line adjusting means being provided in an upper portion of each of the entry-side opening portion and the delivery-side opening portion; and roll gap controlling means for applying a rolling load to the strip by pressing an entry side and a delivery side of the bottom inner housing from below, the roll gap controlling means being provided in a lower portion of each of the entry-side opening portion and the delivery-side opening portion.

In a cluster-type multistage rolling mill according to a second aspect of the present invention solving the above problems, atop entry-side pressing portion to be disposed inside the entry-side opening portion is provided to an entry-side wall portion of the top inner housing, a top delivery-side pressing portion to be disposed inside the delivery-side opening portion is provided to a delivery-side wall portion of the top inner housing, a bottom entry-side pressing portion to be disposed inside the entry-side opening portion is provided to an entry-side wall portion of the bottom inner housing, a bottom delivery-side pressing portion to be disposed inside the delivery-side opening portion is provided to a delivery-side wall portion of the bottom inner housing, the pass line adjusting means is capable of pressing the top entry-side pressing portion and the top delivery-side pressing portion, and the roll gap controlling means is capable of pressing the bottom entry-side pressing portion and the bottom delivery-side pressing portion.

In a cluster-type multistage rolling mill according to a third aspect of the present invention solving the above problems, supporting positions of the pass line adjusting means and the roll gap controlling means in a width direction of the strip are set as positions coinciding with the axial lengths of the roll barrels of work rolls in the top roll group and the bottom roll group.

In a cluster-type multistage rolling mill according to a fourth aspect of the present invention solving the above problems, the pass line adjusting means and the roll gap controlling means are moved based on the strip width of the strip.

A cluster-type multistage rolling mill according to a fifth aspect of the present invention solving the above problems further includes pressing means for thrusting the top inner housing and the bottom inner housing against any one of the entry-side outer housing and the delivery-side outer housing.

A tandem rolling line according to a sixth aspect of the present invention, having multiple rolling mills arranged therein, solving the above problems includes at least one cluster-type multistage rolling mill according to any one of the first to fifth aspects.

Advantageous Effects of Invention

Thus, in the cluster-type multistage rolling mill according to the present invention, the entry-side opening portion of the entry-side outer housing and the delivery-side opening portion of the delivery-side outer housing are configured to support the top inner housing and the bottom inner housing via the pass line adjusting means and the roll gap controlling means; therefore, the size and weight of the rolling mill can be reduced, and also the rigidity thereof can be improved so that a strip can be rolled with a high strip thickness gauge accuracy.

DESCRIPTION OF EMBODIMENTS

Hereinbelow, a cluster-type multistage rolling mill according to the present invention will be described in detail by using the drawings.

Example 1

First, a cluster-type multistage rolling mill according to a first example will be described in detail by using FIGS. 1 to 5.

Figure 1:
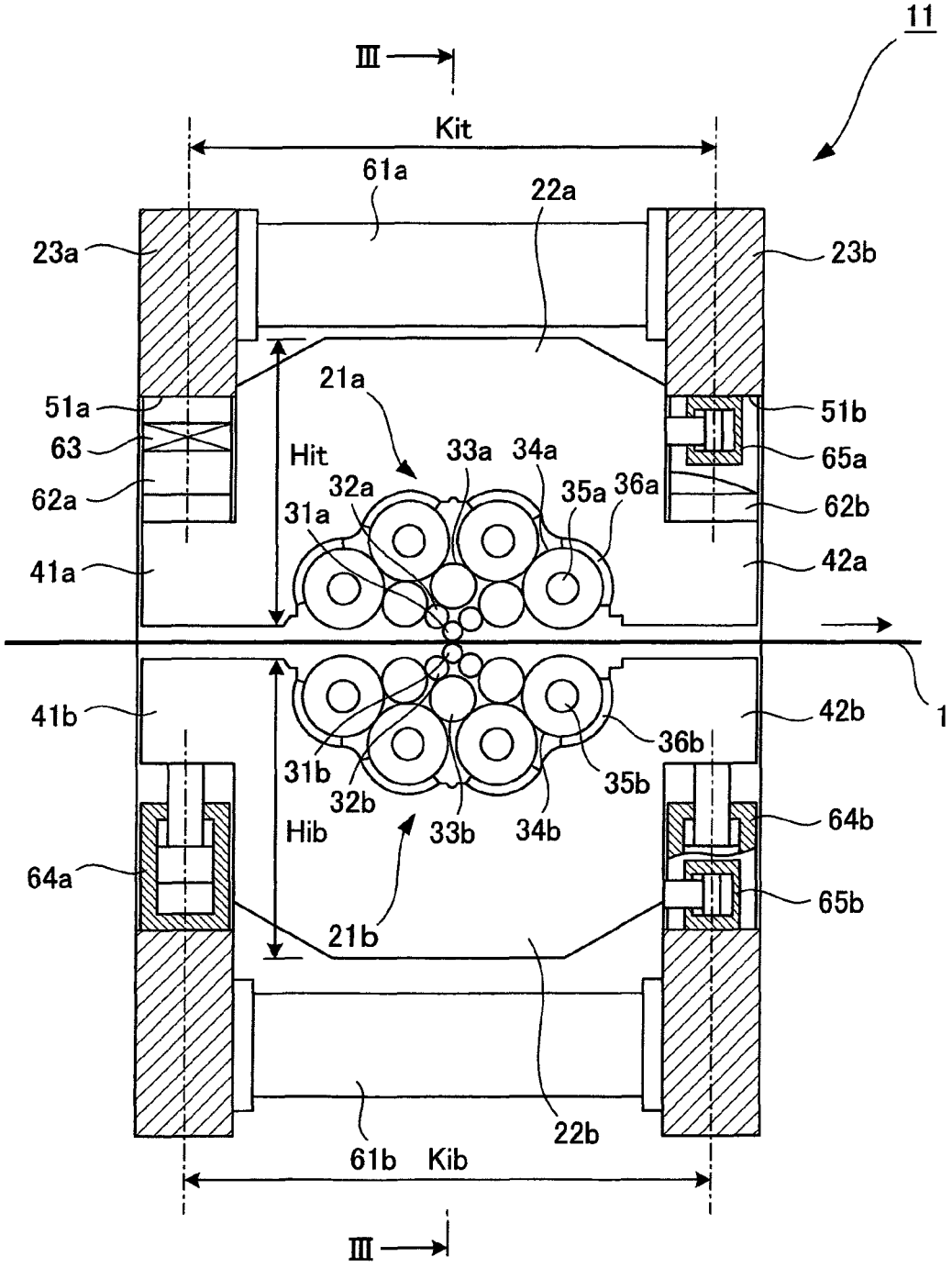
FIG. 1 is a front view of a cluster-type 20-stage rolling mill according to a first example of the present invention.
Figure 2:
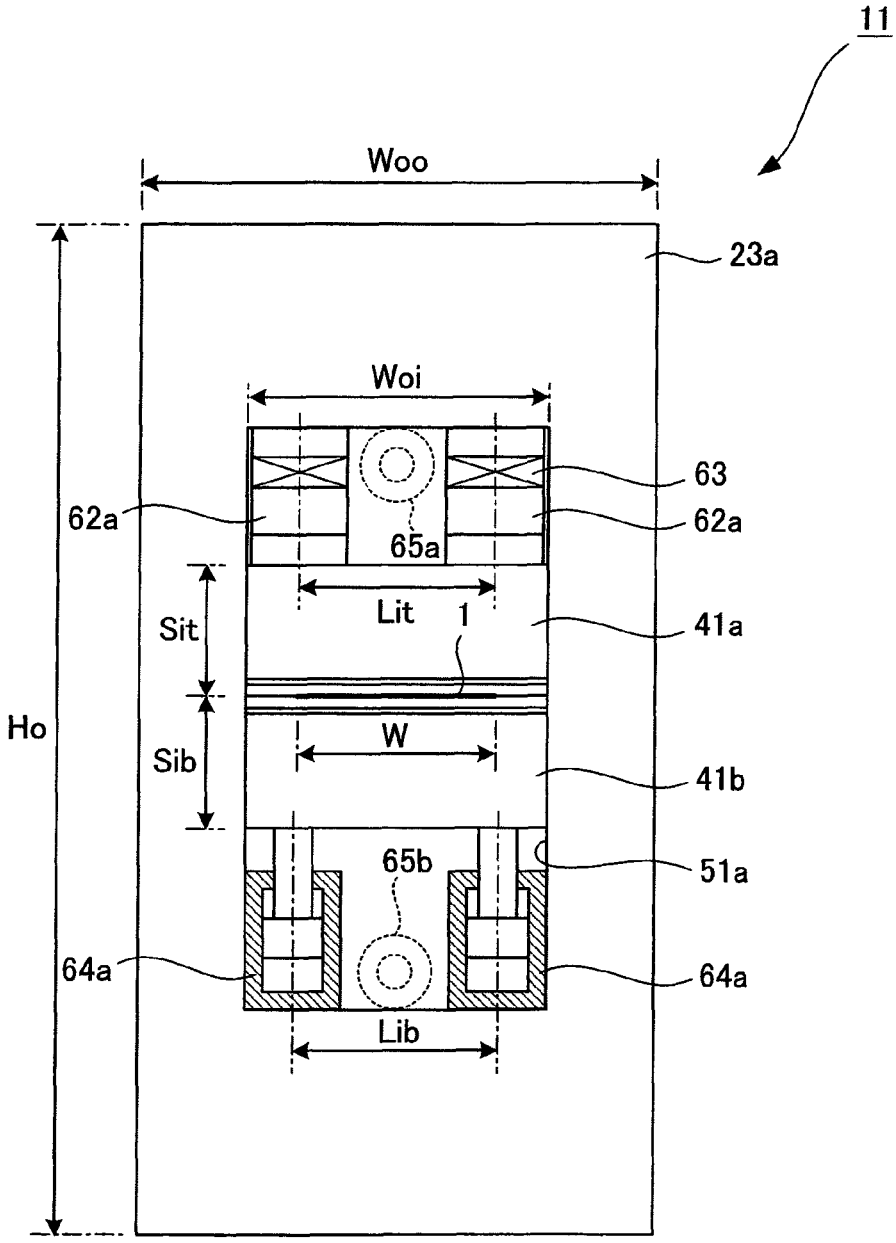
FIG. 2 is an entry-side side view of the cluster-type 20-stage rolling mill according to the first example of the present invention.
Figure 3:
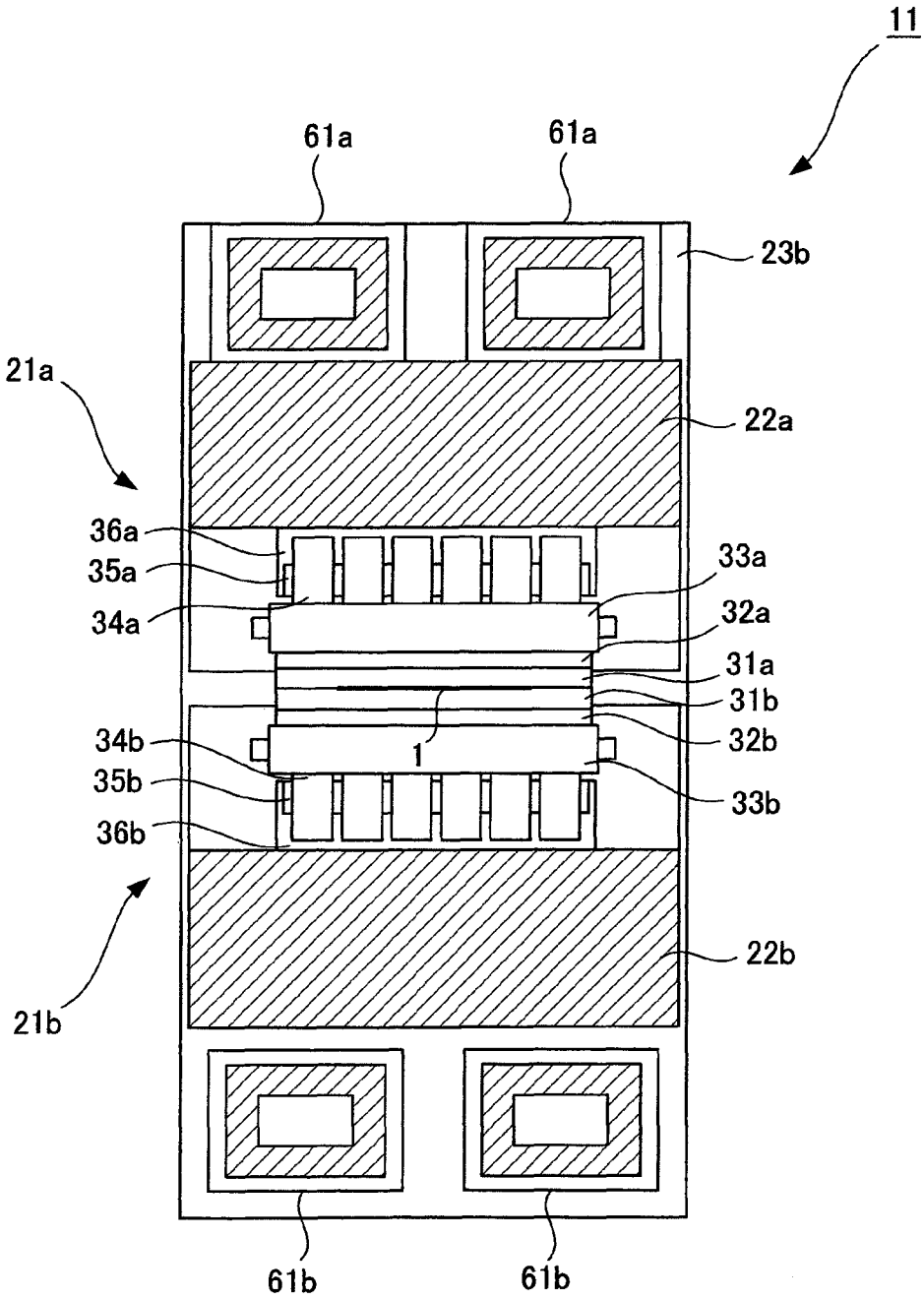
FIG. 3 is a cross-sectional view taken along the arrow of FIG. 1.

A rolling mill 11 shown in FIGS. 1 to 3 serves as one of multiple rolling mills constituting an unillustrated tandem rolling line and is a cluster-type split-housing-type 20-stage rolling mill.

This rolling mill 11 is provided with a top inner housing 22*a* and a bottom inner housing 22*b* disposed above and below the pass line of a strip 1, respectively. The rolling mill 11 is also provided with an entry-side outer housing 23*a* that supports the entry sides of the top inner housing 22*a* and the bottom inner housing 22*b*, and also a delivery-side outer housing 23*b* that supports the deliver sides of the top inner housing 22*a* and the bottom inner housing 22*b*. Between the entry-side outer housing 23*a* and delivery-side outer housing 23*b*, the top inner housing 22*a* and the bottom inner housing 22*b* are each supported movably in a vertical direction.

Between the top inner housing 22*a* and the bottom inner housing 22*b*, a pair of small-diameter top and bottom work rolls 31*a* and 31*b*, two pairs of top and bottom first intermediate rolls 32*a* and 32*b*, three pairs of top and bottom second intermediate rolls 33*a* and 33*b*, and four pairs of top and bottom backing bearings 34*a* and 34*b* are supported rotatably. The first intermediate rolls 32*a* support the work roll 31*a* while the first intermediate rolls 32*b* support the work roll 31*b*. The second intermediate rolls 33*a* support the first intermediate rolls 32*a* while the second intermediate rolls 33*b* support the first intermediate rolls 32*b*. The backing bearings 34*a* support the second intermediate rolls 33*a* while the backing bearings 34*b* support the second intermediate rolls 33*b*. Saddles 36*a* are provided in four rows to an inner side of the top inner housing 22*a* while saddles 36*b* are provided in four rows to an inner side of the bottom inner housing 22*b*. By these rowed saddles 36*a* and 36*b*, backing bearing shafts 35*a* and 35*b* of the backing bearings 34*a* and 34*b* are supported in a rotatable manner, respectively.

In other words, the work roll 31*a*, the first intermediate rolls 32*a*, the second intermediate rolls 33*a*, and the backing bearings 34*a* constitute a top roll group 21*a*, and this top roll group 21*a* is housed inside the top inner housing 22*a*. On the other hand, the work roll 31*b*, the first intermediate rolls 32*b*, the second intermediate rolls 33*b*, and the backing bearings 34*b* constitute a bottom roll group 21*b*, and this bottom roll group 21*b* is housed inside the bottom inner housing 22*b*.

Meanwhile, the top inner housing 22*a* and the bottom inner housing 22*b* have the same shape and have respective heights of Hit and Hib. In entry-side wall portions of the top inner housing 22*a* and the bottom inner housing 22*b*, there are formed entry-side pressing portions 41*a* and 41*b*, respectively, which protrude toward an upstream in the transport direction of the strip 1. In delivery-side wall portions of the top inner housing 22*a* and the bottom inner housing 22*b*, there are formed delivery-side pressing portions 42*a* and 42*b*, respectively, which protrude toward a downstream in the transport direction of the strip 1.

Moreover, the entry-side outer housing 23*a* and the delivery-side outer housing 23*b* have the same shape and formed into frame shapes each with a profile of height Ho×width Woo. They have opening portions 51*a* and 51*b* in their center portions, respectively. The opening portions 51*a* and 51*b* are formed to have an opening width Woi, which is greater than a strip width W of the strip 1, so that the strip 1 can pass therethrough. Further, the entry-side pressing portions 41*a* and 41*b* are disposed inside the opening portion 51*a* while the delivery-side pressing portions 42*a* and 42*b* are disposed inside the opening portion 51*b*.

Note that the entry-side outer housing 23*a* and the delivery-side outer housing 23*b* are coupled to each other by a pair of left and right (drive-side and work-side) housing separators 61*a* placed above the top inner housing 22*a* and a pair of left and right (drive-side and work-side) housing separators 61*b* placed below the bottom inner housing 22*b*.

A pair of left and right pass line adjusters (pass line adjusting means) 62*a* and a pair of left and right pass line adjusters (pass line adjusting means) 62*b* are provided to upper surfaces (lower surfaces of upper beams) of the opening portions 51*a* and 51*b*, respectively. The pass line adjusters 62*a* can press an upper surface of the entry-side pressing portion 41*a* while the pass line adjusters 62*b* can press an upper surface of the delivery-side pressing portion 42*a*. Here, a distance Kit is set as the distance between the center of each pass line adjuster 62*a* and the center of the corresponding pass line adjuster 62*b* in the transport direction of the strip 1.

According to this configuration, as the pass line adjusters 62*a* and 62*b* are driven, the top inner housing 22*a* and the bottom inner housing 22*b* move in the same vertical direction, whereby the pass line of the strip 1 can be adjusted in the vertical direction. Note that the pass line adjusters 62*a* and 62*b* each include therein a load cell 63 that detects a rolling load P (see FIG. 9).

In contrast, a pair of left and right roll gap control cylinders (roll gap controlling means) 64*a* and a pair of left and right roll gap control cylinders (roll gap controlling means) 64*b* are provided to lower surfaces (upper surfaces of lower beams) of the opening portions 51*a* and 51*b*, respectively. The roll gap control cylinders 64*a* can press a lower surface of the entry-side pressing portion 41*b* while the roll gap control cylinders 64*b* can press a lower surface of the delivery-side pressing portion 42*b*. Here, a distance Kib is set as the distance between the center of each roll gap control cylinder 64*a* and the center of the corresponding roll gap control cylinder 64*b* in the transport direction of the strip 1. Note that the distances Kit and Kib are the same distance.

According to this configuration, as the roll gap control cylinders 64*a* and 64*b* are driven, the top inner housing 22*a* and the bottom inner housing 22*b* move to get closer to each other in the vertical direction, whereby a rolling load P generated along with such movement can be applied to the strip 1 via the top roll group 21*a* and the bottom roll group 21*b*. While the roll gap control cylinders 64*a* and 64*b* are driven (while rolling is performed), the rolling load P is always detected by the load cells 63.

Here, the opening portions 51*a* and 51*b* are so formed that their opening widths Woi would be shorter (narrower) than the axial lengths of the roll barrels of the work rolls 31*a* and 31*b*. Accordingly, the positions at which the pass line adjusters 62*a* and 62*b* support (press) the upper faces of the entry-side pressing portion 41*a* and the deliver-side pressing portion 42*a* are always set as positions coinciding with the axial lengths of the roll barrels of the work rolls 31*a* and 31*b* in the axial direction (strip width direction) thereof.

In addition, the pass line adjusters 62*a* and 62*b* have unillustrated top moving means connected thereto. A distance Lit is set as the distance between the centers of the pass line adjusters 62*a* in the strip width direction and also as the distance between the centers of the pass line adjusters 62*b* in the strip width direction. The distance Lit can be adjusted by the top moving means on the basis of the strip width W of the strip 1. Note that a distance Sit is set as the distances (heights) between the pass line of the strip 1 and the upper surfaces of the entry-side pressing portion 41*a* and the delivery-side pressing portion 42*a*, i.e., the positions at which the pass line adjusters 62*a* and 62*b* support the upper faces of the entry-side pressing portion 41*a* and the delivery-side pressing portion 42*a*.

Likewise, since the opening portions 51*a* and 51*b* are so formed that their opening widths Woi would be shorter (narrower) than the axial lengths of the roll barrels of the work rolls 31*a* and 31*b*, the positions at which the roll gap control cylinders 64*a* and 64*b* support (press)) the lower faces of the entry-side pressing portion 41*b* and the delivery-side pressing portion 42*b* are always set as the positions coinciding with the axial lengths of the roll barrels of the work rolls 31*a* and 31*b* in the axial direction (strip width direction) thereof.

Meanwhile, the roll gap control cylinders 64*a* and 64*b* have unillustrated bottom moving means connected thereto. A distance Lib is set as the distance between the centers of the roll gap control cylinders 64*a* in the strip width direction and also as the distance between the centers of the roll gap control cylinders 64*b* in the strip width direction. The distance Lib can be adjusted by the bottom moving means on the basis of the strip width W of the strip 1. Here, the pass line adjusters 62*a* and 62*b* and the roll gap control cylinders 64*a* and 64*b* are designed to be moved to make such adjustment that the distances Lit and Lib would be the same. Note that a distance Sib is set as the distances (heights) between the pass line of the strip 1 and the lower surfaces of the entry-side pressing portion 41*b* and the delivery-side pressing portion 42*b*, i.e., the positions at which the roll gap control cylinders 64*a* and 64*b* support the lower faces of the entry-side pressing portion 41*b* and the delivery-side pressing portion 42*b*.

Further, paired top and bottom pressing cylinders (pressing means) 65*a* and 65*b* are provided between the pass line adjusters 62*b* located on the upper surface of the opening portion 51*b* and between the roll gap control cylinders 64*b* located on the lower surface of the opening portion 51*b*, respectively. These pressing cylinders 65*a* and 65*b* are capable of pressing the delivery-side wall portions of the top inner housing 22*a* and the bottom inner housing 22*b*, respectively.

According to this configuration, as the pressing cylinders 65*a* and 65*b* are driven, the top inner housing 22*a* and the bottom inner housing 22*b* are pressed toward the upstream in the transport direction of the strip 1 and thereby thrust against the entry-side outer housing 23*a*. Hence, gaps between the entry-side outer housing 23*a* and the top and bottom inner housings 22*a* and 22*b* disappear. This eliminates the rattling of the top and bottom inner housings 22*a* and 22*b*, meaning that the work rolls 31*a* and 31*b* are prevented from being in a cross arrangement. As a result, the strip 1 can be rolled to have a stable product quality.

Note that in this embodiment, the pass line adjusters 62*a* and 62*b* are provided to the top inner housing 22*a* and the roll gap control cylinders 64*a* and 64*b* are provided to the bottom inner housing 22*b*; however, the pass line adjusters 62*a* and 62*b* may be provided to the bottom inner housing 22*b* and the roll gap control cylinders 64*a* and 64*b* may be provided to the top inner housing 22*a* instead. Moreover, the paired top and bottom pressing cylinders 65*a* and 65*b* may be provided between the pass line adjusters 62*a* located on the upper surface of the opening portion 51*a* and between the roll gap control cylinders 64*a* located on the lower surface of the opening portion 51*a*. In this case, as the pressing cylinders 65*a* and 65*b* are driven, the top inner housing 22*a* and the bottom inner housing 22*b* are pressed toward the downstream in the transport direction of the strip 1 and thereby thrust against the delivery-side outer housing 23*b*. This can also eliminate the rattling of the top inner housing 22*a* and the bottom inner housing 22*b*.

Next, bore opening of the top inner housing 22*a* and the bottom inner housing 22*b* at the time of rolling will be described by using FIGS. 4 and 5.

Note that the paths through which rolling reaction force P is transmitted at the time of rolling (the proportions of rolling reaction force applied) are identical between the top roll group 21*a* and the bottom roll group 21*b*. Thus, in FIGS. 4 and 5, how the deformation occurs is illustrated only for the top inner housing 22*a*. The positions of the shaft centers of the backing bearing shafts 35*a* of the backing bearings 34*a* are indicated as positions A to D in the order starting from the most upstream one in the transport direction of the strip 1.

Here, to the rolling mill 11, there are attached: the work rolls 31*a* and 31*b* whose roll diameters are ϕ60; the first intermediate rolls 32*a* and 32*b* whose roll diameters are ϕ39; the second intermediate rolls 33*a* and 33*b* whose roll diameters are ϕ230; and the backing bearings 34*a* and 34*b* whose bearing diameters are ϕ406. The rolling mill 11 is configured to roll a strip 1 of the strip width W (e.g., 1300 mm) with the rolling load P (e.g., 1000 ton).

Figure 9:
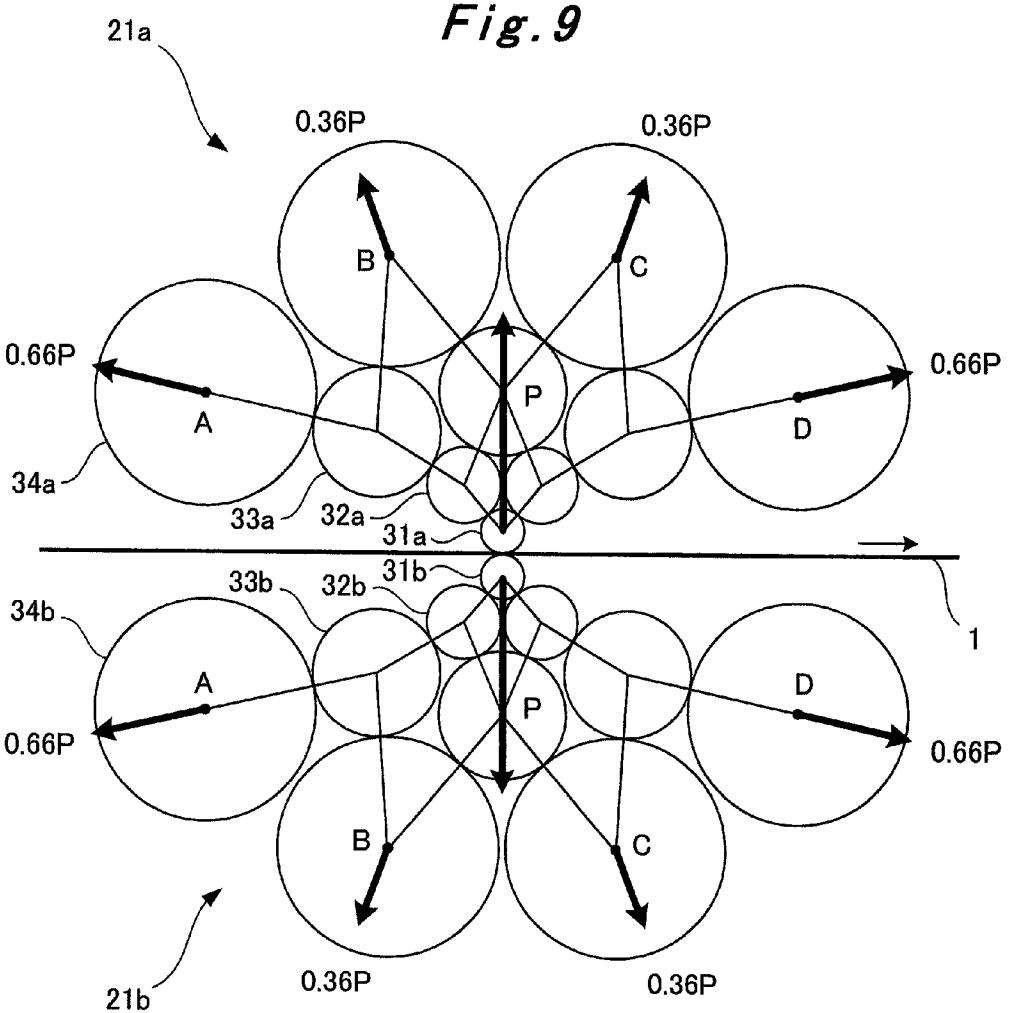
CONVENTIONAL ART Fig. 9
FIG. 9 is a diagram showing the proportions of rolling reaction force applied to backing bearings at positions A to D at the time of rolling.

In the rolling using the rolling mill 11, rolling reactive force P from the strip 1 acts on the work rolls 31*a* and 31*b* as shown in FIG. 9. The rolling reactive force P is distributed to the backing bearings 34*a* and 34*b* through the first intermediate rolls 32*a* and 32*b* and the second intermediate rolls 33*a* and 33*b*. As a result, rolling reaction force of 0.66 P is applied to the backing bearings 34*a* and 34*b* at the positions A and D, and rolling reaction force of 0.36 P is applied to the backing bearings 34*a* and 34*b* at the positions B and C. In other words, the proportions of the rolling reaction force applied to the backing bearings 34*a* and 34*b* at the positions A and D are 66%, while the proportions of the rolling reaction force applied to the backing bearings 34*a* and 34*b* at the positions B and C are 36%.

Figure 4:
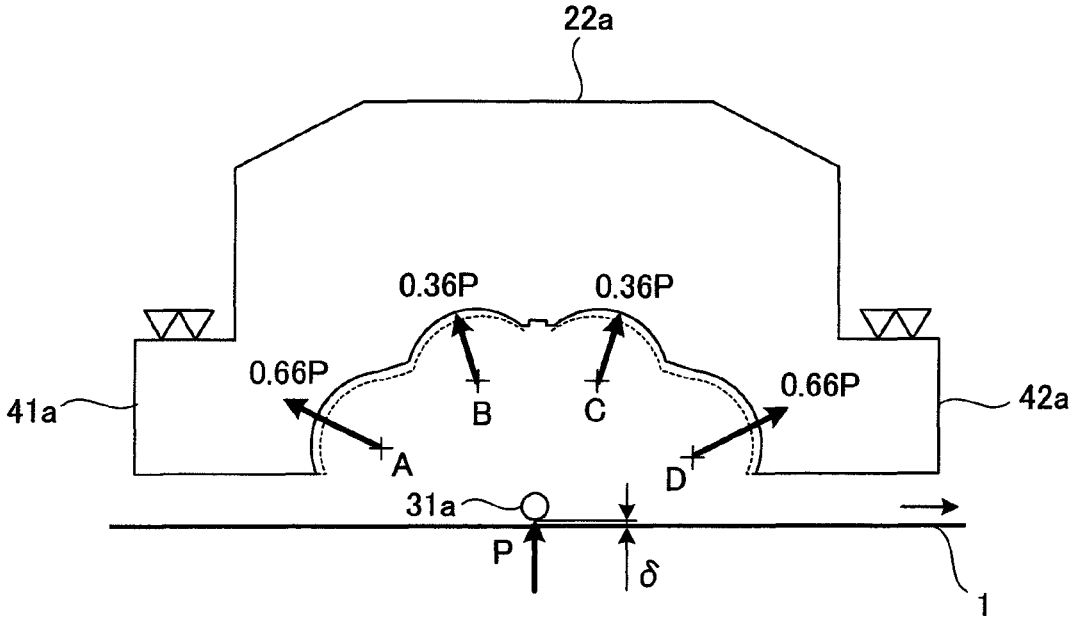
FIG. 4 is a diagram showing how the deformation (bore opening) of a top inner housing occurs.

In this event, as shown in FIG. 4, the rolling reaction force distributed to the backing bearings 34*a* and 34*b* at the positions A and D acts in nearly horizontal directions. This makes the top inner housing 22*a* and the bottom inner housing 22*b* likely to deform in the horizontal directions and to be in a bore-opening state.

To solve this, in the rolling mill 11, the entry-side pressing portion 41*a* and the delivery-side pressing portion 42*a* are so formed on the top inner housing 22*a* as to be disposed at lower positions than the upper surface of the top inner housing 22*a*. Moreover, the entry-side pressing portion 41*b* and the deliver-side pressing portion 42*b* are so formed on the bottom inner housing 22*b* as to be disposed at higher positions than the lower surface of the bottom inner housing 22*b*. In this way, the distances Kit and Kib can be made long and the distances Sit and Sib can be made short. This makes it possible to improve the vertical rigidities of the top inner housing 22*a* and the bottom inner housing 22*b* and therefore to suppress the occurrence of the bore opening thereof.

Meanwhile, at the time of rolling, the top inner housing 22*a* and the bottom inner housing 22*b* may deflect greatly in the strip width direction, which in turn adversely affects the strip shape of the strip 1.

To solve this, in the rolling mill 11, the pass line adjusters 62*a* and 62*b* to press the entry-side pressing portion 41*a* and the delivery-side pressing portion 42*a* are provided to the lower surfaces of the opening portions 51*a* and 51*b*. Moreover, the roll gap control cylinders 64*a* and 64*b* to press the entry-side pressing portion 41*b* and the delivery-side pressing portion 42*b* are provided to the upper surfaces of the opening portions 51*a* and 51*b*. In this way, the positions at which the pass line adjusters 62*a* and 62*b* support the upper faces of the entry-side pressing portion 41*a* and the delivery-side pressing portion 42*a*, as well as the positions at which the roll gap control cylinders 64*a* and 64*b* support the lower faces of the entry-side pressing portion 41*b* and the delivery-side pressing portion 42*b* can be set as the positions coinciding with the axial lengths of the roll barrels of the work rolls 31*a* and 31*b* in the axial direction thereof. At this time, the distances Lit between the pass line adjusters 62*a* and between the pass line adjusters 62*b*, as well as the distances Lib between the roll gap control cylinders 64*a* and between the roll gap control cylinders 64*b* are adjusted based on the strip width W of the strip 1, and therefore can be made as short as possible. This makes it possible to improve the horizontal rigidities of the top inner housing 22*a* and the bottom inner housing 22*b* and therefore to suppress the occurrence of the deflection thereof.

Figure 5:
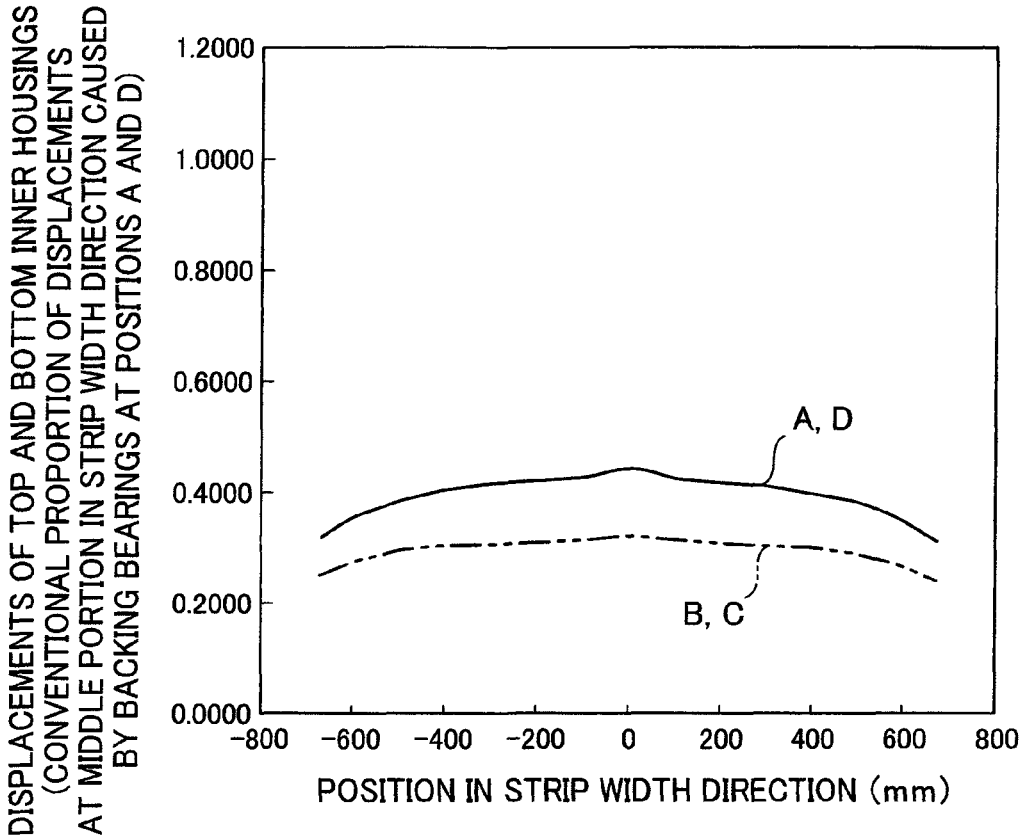
FIG. 5 is a graph showing the distribution, in the strip width direction, of rolling reaction force acting direction displacements of the top inner housing caused by backing bearings at positions A to D.
Figure 10:
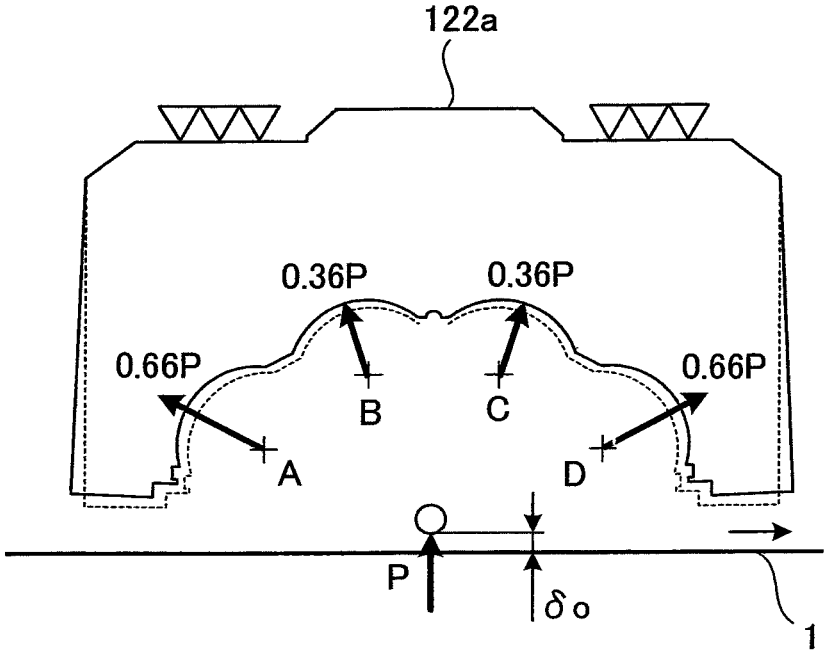
CONVENTIONAL ART Fig. 10
FIG. 10 is a diagram showing how the deformation (bore opening) of a top inner housing in a conventional cluster-type multistage rolling mill occurs.
Figure 11:
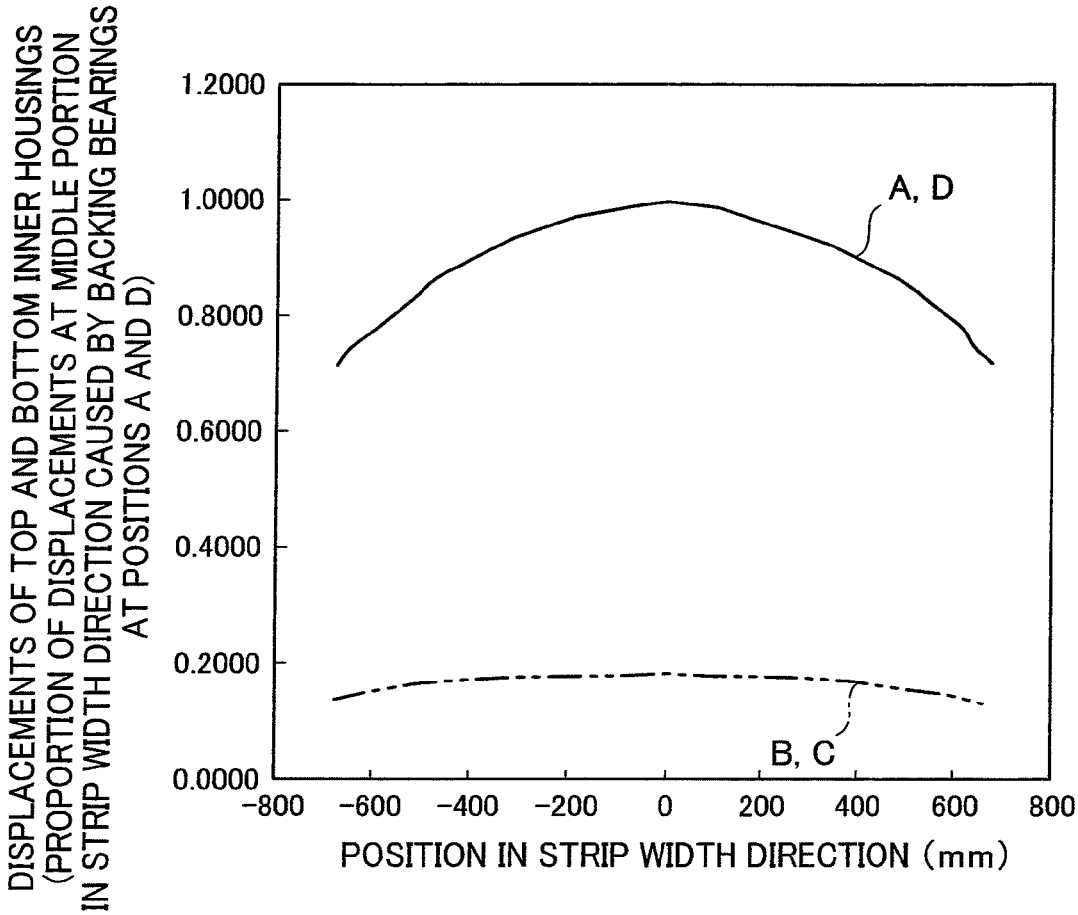
CONVENTIONAL ART Fig. 11
FIG. 11 is a graph showing the distribution, in the strip width direction, of rolling reaction force acting direction displacements of a conventional top inner housing caused by backing bearings at positions A to D.

Specifically, as shown in FIG. 5, the distribution, in the strip width direction, of the rolling reaction force acting direction displacements of the top inner housing 22*a* and the bottom inner housing 22*b* caused by the backing bearings 34*a* and 34*b* at the positions B and C is slightly larger as a whole than that of the conventional case shown in FIG. 10. However, the distribution, in the strip width direction, of the rolling reaction force acting direction displacements of the top inner housing 22*a* and the bottom inner housing 22*b* caused by the backing bearings 34*a* and 34*b* at the positions A and D is significantly smaller than that of the conventional case shown in FIG. 10.

Note that the rolling reaction force acting direction displacements of the top inner housing 22*a* and the bottom inner housing 22*b* caused by the backing bearings 34*a* and 34*b* at the positions A to D represent values using, as a reference, the rolling reaction force acting direction displacement of the top inner housing 122*a* at the middle portion in the strip width direction caused by the backing bearings 34*a* and 34*b* at the positions A and D shown in FIG. 10.

Meanwhile, in the distribution, in the strip width direction, of the rolling reaction force acting direction displacements of the top inner housing 22*a* and the bottom inner housing 22*b* caused by the backing bearings 34*a* and 34*b* at the positions A and D, the difference is significantly small between the rolling reaction force acting direction displacement at the middle portion in the strip width direction and those at the two end portions in the strip width direction.

The rolling reaction force acting direction displacements of the top inner housing 22*a* and the bottom inner housing 22*b* at the middle and two end portions in the strip width direction caused by the backing bearings 34*a* and 34*b* at the positions A and D are converted into the rolling reaction force acting direction displacements of the work rolls 31*a* and 31*b* at the middle and two end portions in the strip width direction caused by the backing bearings 34*a* and 34*b* at the positions A and D. For the work rolls 31*a* and 31*b* too, the difference is significantly small between the rolling reaction force acting direction displacement at the middle portion in the strip width direction and those at the two end portions in the strip width direction. In sum, the middle portion and two end portions of the strip 1 in the strip width direction are pressed to a similar extent. Accordingly, the middle portion and two end portions in the strip width direction are controlled to have similar strip thicknesses.

Thus, as shown in FIG. 4, by improving the vertical and horizontal rigidities of the top inner housing 22*a* and the bottom inner housing 22*b*, a gap 5 between the strip 1 and each of the work rolls 31*a* and 31*b* can be made small. Consequently, the strip 1 can be rolled highly precisely. Here, it was found that the gap 5 became significantly small as it was only 54% of the gap δo in the conventional case shown in FIG. 10. To put it differently, it is $(\delta o/\delta)=(1/0.54)=1.85$, indicating that the rigidities of the top inner housing 22*a* and the bottom inner housing 22*b* are improved by 1.85 times more than the conventional case.

Additionally, in the top inner housing 22*a* and the bottom inner housing 22*b*, the distances Lit and Lib and the distances Sit and Sib can be made short; thus, the heights Ho and the widths Woo of the entry-side outer housing 23*a* and the delivery-side outer housing 23*b* can be made short. This makes it possible to reduce the sizes and weights of the entry-side outer housing 23*a* and the delivery-side outer housing 23*b*. Further, as the vertical and horizontal rigidities of the top inner housing 22*a* and the bottom inner housing 22*b* are improved, the heights Hit and Hib thereof can be made accordingly smaller. This makes it possible to reduce the sizes and weights of the top inner housing 22*a* and the bottom inner housing 22*b* as well.

Example 2

Next, a cluster-type multistage rolling mill according to a second example will be described in detail by using FIG. 6.

Figure 6:
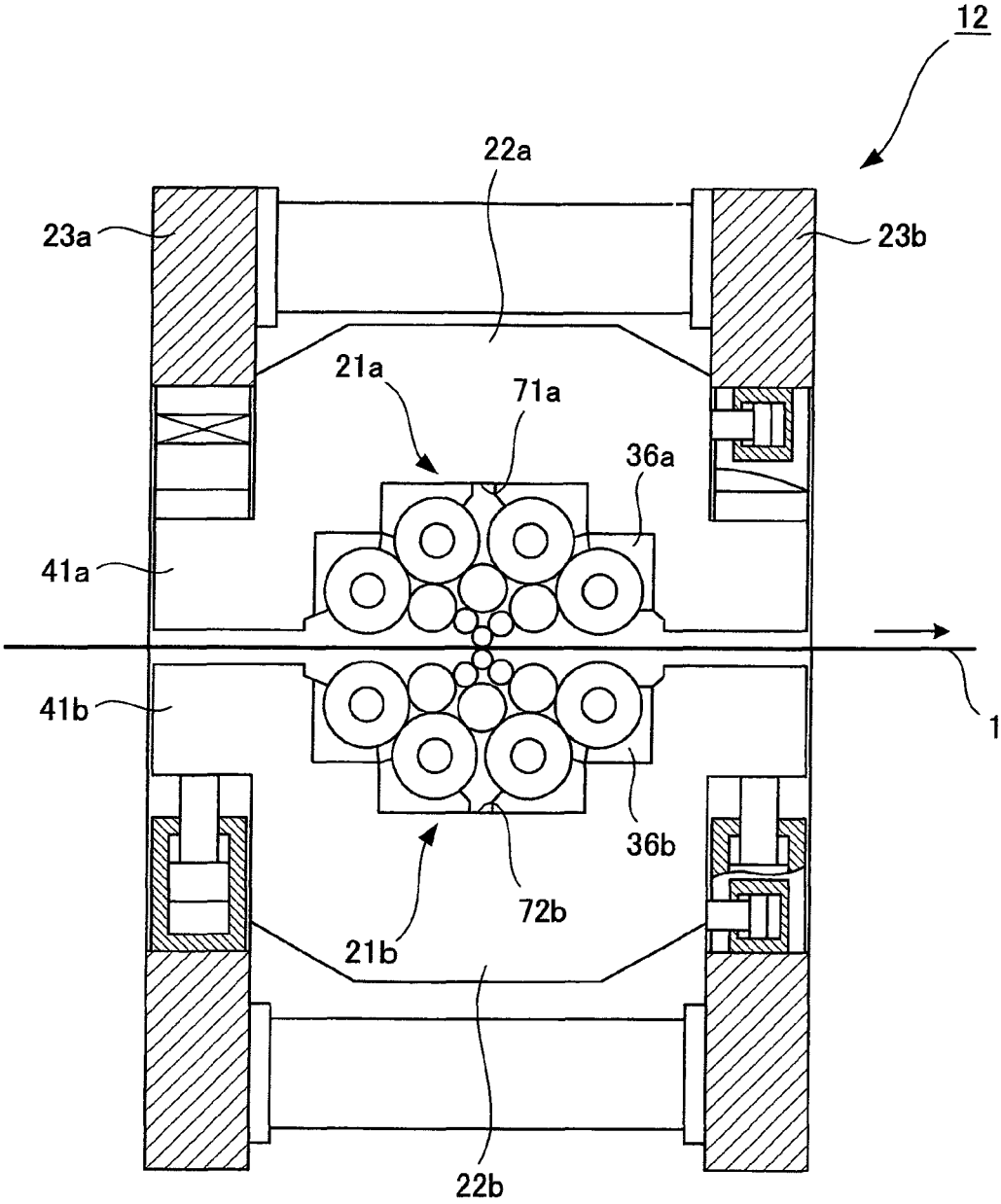
FIG. 6 is a front view of a cluster-type 20-stage rolling mill according to a second example of the present invention.

A rolling mill 12 shown in FIG. 6 serves as one of multiple rolling mills constituting an unillustrated tandem rolling line and is a cluster-type split-housing-type 20-stage rolling mill. In this rolling mill 12, saddle support surfaces 71*a* and 71*b* for the saddles 36*a* and 36*b* in the top inner housing 22*a* and the bottom inner housing 22*b* are formed as horizontal and vertical surfaces. This permits the saddle support surfaces 71*a* and 71*b* to be worked in a simpler manner.

Example 3

Next, a cluster-type multistage rolling mill according to a third example will be described in detail by using FIG. 7.

Figure 7:
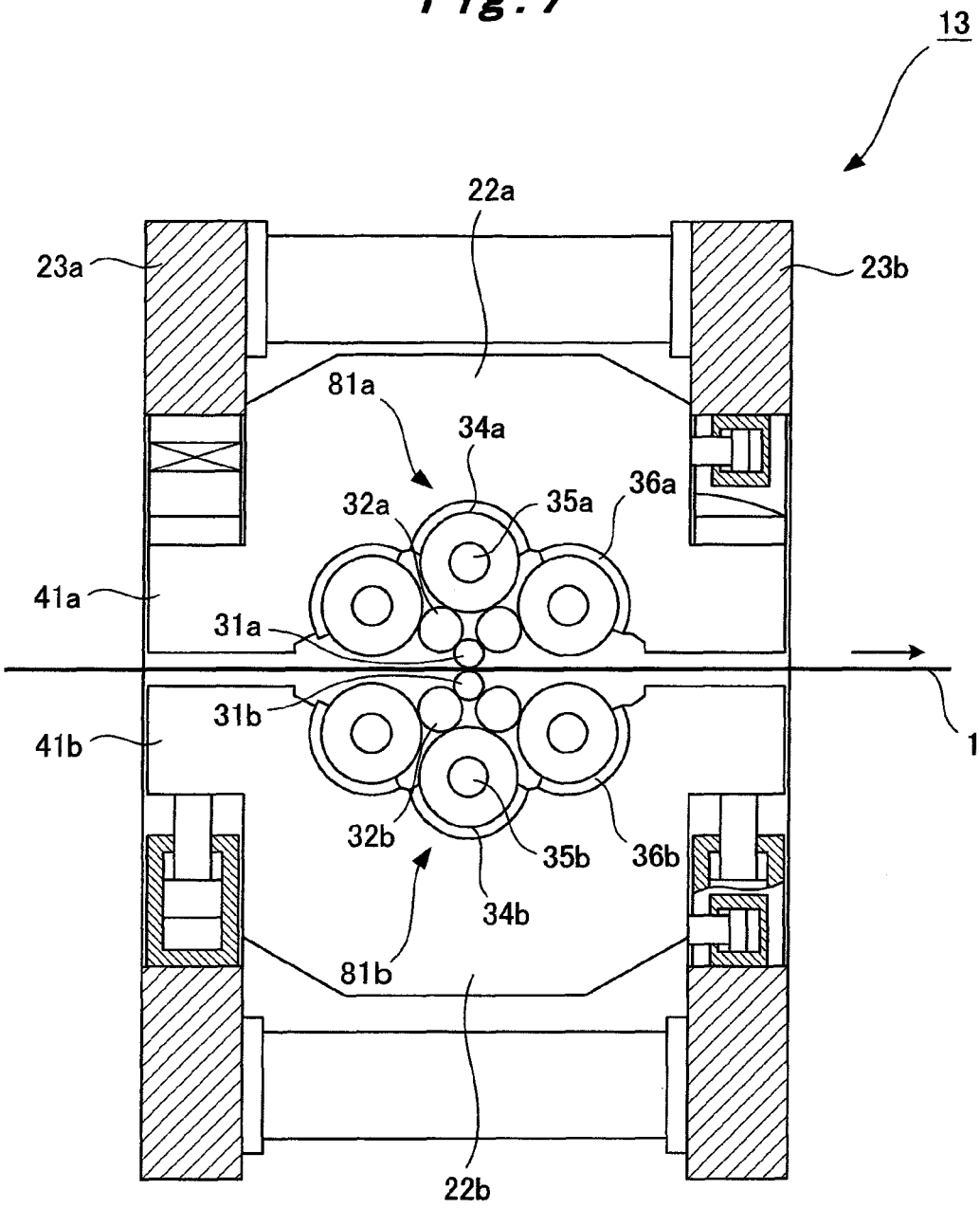
FIG. 7 is a front view of a cluster-type 12-stage rolling mill according to a third example of the present invention.

A rolling mill 13 shown in FIG. 7 serves as one of multiple rolling mills constituting an unillustrated tandem rolling line and is a cluster-type split-housing-type 12-stage rolling mill. By this rolling mill 13, a pair of work rolls 31*a* and 31*b*, two pairs of top and bottom first intermediate rolls 32*a* and 32*b*, three pairs of top and bottom backing bearings 34*a* and 34*b* are supported rotatably.

In other words, the work roll 31*a*, the first intermediate rolls 32*a*, and the backing bearings 34*a* constitute a top roll group 81*a*, and this top roll group 81*a* is housed inside the top inner housing 22*a*. On the other hand, the work roll 31*b*, the first intermediate rolls 32*b*, and the backing bearings 34*b* constitute a bottom roll group 81*b*, and this bottom roll group 81*b* is housed inside the bottom inner housing 22*b*.

Accordingly, even the rolling mill 13 with a small number of rolls can achieve a reduction in size and weight as well as an improvement in vertical and horizontal rigidities. Consequently, a strip 1 can be rolled with a high strip thickness gauge accuracy.

Example 4

Next, a cluster-type multistage rolling mill according to a fourth example will be described in detail by using FIG. 8.

Figure 8:
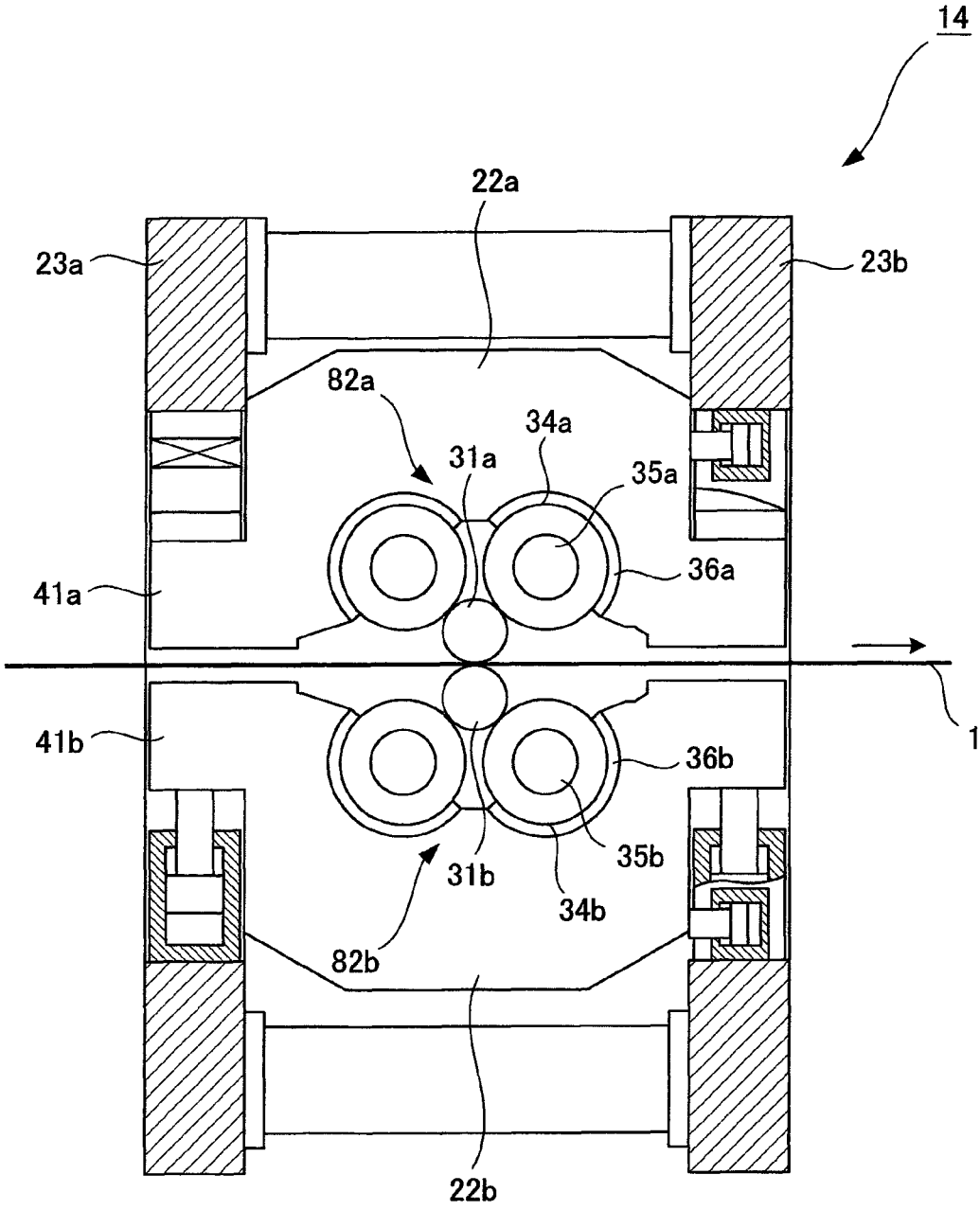
FIG. 8 is a front view of a cluster-type 6-stage rolling mill according to a fourth example of the present invention.

A rolling mill 14 shown in FIG. 8 serves as one of multiple rolling mills constituting an unillustrated tandem rolling line and is a cluster-type split-housing-type 6-stage rolling mill. By this rolling mill 14, a pair of work rolls 31*a* and 31*b* and two pairs of top and bottom backing bearings 34*a* and 34*b* are supported rotatably.

In other words, the work roll 31*a* and the backing bearings 34*a* constitute a top roll group 82*a*, and this top roll group 82*a* is housed inside the top inner housing 22*a*. On the other hand, the work roll 31*b* and the backing bearings 34*b* constitute a bottom roll group 82*b*, and this bottom roll group 82*b* is housed inside the bottom inner housing 22*b*.

Accordingly, even the rolling mill 14 with a small number of rolls can achieve a reduction in size and weight as well as an improvement in vertical and horizontal rigidities. Consequently, a strip 1 can be rolled with a high strip thickness gauge accuracy.

Note that in any of the rolling mills 11 to 14 described above, a roll bending device to adjust the rolling load P on a strip 1 may be provided by making the backing bearings 34*a* and 34*b* eccentric.

INDUSTRIAL APPLICABILITY

The present invention is applicable to multistage rolling mills capable of highly precise control on the strip shape of a strip.

REFERENCE SIGNS LIST

1 STRIP
11 to 14 ROLLING MILL
21*a* TOP ROLL GROUP
21*b* BOTTOM ROLL GROUP
22*a* TOP INNER HOUSING
22*b* BOTTOM INNER HOUSING
23*a* ENTRY-SIDE OUTER HOUSING
23*b* DELIVERY-SIDE OUTER HOUSING
31*a*, 31*b* WORK ROLL
32*a*, 32*b* FIRST INTERMEDIATE ROLL
33*a*, 33*b* SECOND INTERMEDIATE ROLL
34*a*, 34*b* BACKING BEARING
35*a*, 35*b* BACKING BEARING SHAFT
41*a*, 41*b* ENTRY-SIDE PRESSING PORTION
42*a*, 42*b* DELIVERY-SIDE PRESSING PORTION
51*a*, 51*b* OPENING PORTION
61*a*, 61*b* HOUSING SEPARATOR
62*a*, 62*b* PASS LINE ADJUSTER
63 LOAD CELL
64*a*, 64*b* ROLL GAP CONTROL CYLINDER
65*a*, 65*b* PRESSING CYLINDER

The invention claimed is:

1. A cluster-type multistage rolling mill comprising:

a top inner housing located above a pass line of a strip and housing a top roll group including rolls arranged in a clustered form;

a bottom inner housing located below the pass line of the strip and housing a bottom roll group including rolls arranged in a clustered form;

an entry-side outer housing provided at entry sides of the top inner housing and the bottom inner housing and formed in such a frame shape that an entry-side opening portion which the strip is allowed to pass through is opened at a position upstream of the top inner housing and the bottom inner housing in a strip transport direction;

a delivery-side outer housing provided at delivery sides of the top inner housing and the bottom inner housing and formed in such a frame shape that a delivery-side opening portion which the strip is allowed to pass through is opened at a position downstream of the top inner housing and the bottom inner housing in the strip transport direction;

pass line adjusting means for adjusting a height of the pass line of the strip by pressing an entry side and a delivery side of the top inner housing from above, the pass line adjusting means being provided in an upper portion of each of the entry-side opening portion and the delivery-side opening portion; and roll gap controlling means for applying a rolling load to the strip by pressing an entry side and a delivery side of the bottom inner housing from below, the roll gap controlling means being provided in a lower portion of each of the entry-side opening portion and the delivery-side opening portion, wherein a top entry-side pressing portion to be disposed at a lower position than an upper surface of the top inner housing and inside the entry-side opening portion is provided to protrude from an entry-side wall portion of the top inner housing toward an upstream in the strip transport direction, a top delivery-side pressing portion to be disposed at a lower position than the upper surface of the top inner housing and inside the delivery-side opening portion is provided to protrude from a delivery-side wall portion of the top inner housing toward a downstream in the strip transport direction, a bottom entry-side pressing portion to be disposed at a higher position than a lower surface of the bottom inner housing and inside the entry-side opening portion is provided to protrude from an entry-side wall portion of the bottom inner housing toward the upstream in the strip transport direction, a bottom delivery-side pressing portion to be disposed at a higher position than the lower surface of the bottom inner housing and inside the delivery-side opening portion is provided to protrude from a delivery-side wall portion of the bottom inner housing toward the downstream in the strip transport direction, the pass line adjusting means is capable of pressing upper surfaces of the top entry-side pressing portion and the top delivery-side pressing portion, and the roll gap controlling means is capable of pressing lower surfaces of the bottom entry-side pressing portion and the bottom delivery-side pressing portion.

2. The cluster-type multistage rolling mill according to claim 1, wherein supporting positions of the pass line adjusting means and the roll gap controlling means in a width direction of the strip are set as positions coinciding with the axial lengths of the roll barrels of work rolls in the top roll group and the bottom roll group.

3. The cluster-type multistage rolling mill according to claim 1, wherein the pass line adjusting means and the roll gap controlling means are moved based on the strip width of the strip.

4. The cluster-type multistage rolling mill according to claim 1, further comprising pressing means for thrusting the top inner housing and the bottom inner housing against any one of the entry-side outer housing and the delivery-side outer housing.

5. A tandem rolling line having a plurality of rolling mills arranged therein, comprising at least one cluster-type multistage rolling mill according to claim 1.

6. A tandem rolling line having a plurality of rolling mills arranged therein, comprising at least one cluster-type multistage rolling mill according to claim 1.

7. A tandem rolling line having a plurality of rolling mills arranged therein, comprising at least one cluster-type multistage rolling mill according to claim 2.

8. A tandem rolling line having a plurality of rolling mills arranged therein, comprising at least one cluster-type multistage rolling mill according to claim 3.

9. A tandem rolling line having a plurality of rolling mills arranged therein, comprising at least one cluster-type multistage rolling mill according to claim 4.

* * * * *